US005577684A

United States Patent [19]

Dropczynski et al.

[11] Patent Number: 5,577,684

[45] Date of Patent: Nov. 26, 1996

[54] WINDING MACHINE WITH SUPPORT CYLINDERS

[75] Inventors: Hartmut Dropczynski, Dormagen; Michael Kuhnhold, Mönchengladbach, both of Germany

[73] Assignee: Jagenberg Papiertechnik GmbH, Neuss, Germany

[21] Appl. No.: 433,356

[22] PCT Filed: Oct. 5, 1994

[86] PCT No.: PCT/EP94/03288

§ 371 Date: May 2, 1995

§ 102(e) Date: May 2, 1995

[87] PCT Pub. No.: WO95/09795

PCT Pub. Date: Apr. 13, 1995

[30] Foreign Application Priority Data

Oct. 6, 1993 [DE] Germany ..... 43 34 029.6

[51] Int. Cl.[6] ..... B65H 19/30

[52] U.S. Cl. ..... 242/533.2; 242/542

[58] Field of Search ..... 242/533.2, 533.3, 242/542, 521, 526.1

[56] References Cited

U.S. PATENT DOCUMENTS

| | | | |
|---|---|---|---|
| 4,789,109 | 12/1988 | Kyytsonen et al. | 242/533.2 |
| 5,222,679 | 6/1993 | Dropczynski et al. | 242/533.2 X |

FOREIGN PATENT DOCUMENTS

| | | |
|---|---|---|
| 3811871A1 | 10/1989 | Germany . |
| 4003504A1 | 8/1991 | Germany . |
| 2065081 | 6/1981 | United Kingdom . |
| 2183610 | 6/1987 | United Kingdom . |

*Primary Examiner*—John M. Jillions
*Attorney, Agent, or Firm*—Herbert Dubno

[57] ABSTRACT

A winding machine for winding a paper or cardboard web on cores in a bed between two support cylinders has an ejector beam swingable about the input support cylinder and an ejection surface which extends radially with respect to the latter and is associated with a lifting roller on one side of that surface. The lifting roller has a free wheel lock which allows the lifting roller to rotate in the same sense as the input support cylinder but prevents rotation of the lift roller in the opposite sense.

4 Claims, 10 Drawing Sheets

WINDING MACHINE WITH SUPPORT CYLINDERS

CROSS REFERENCE TO RELATED APPLICATIONS

This application is a national phase of PCT/EP94/03288 filed 5 Oct. 1994 and based, in turn, on German national application P 43 34 029.6 filed 6 Oct. 1993 under the International Convention.

The invention relates to a winding machine with support cylinders for winding webs of material, particularly paper or cardboard webs, onto cores.

BACKGROUND OF THE INVENTION

In winding machines with support cylinders roll ejection devices and core insertion devices are known which during roll change eject the full rolls from the winding bed and introduce new cores into the winding bed.

From DE-OS 38 11 871 it is known to use as an ejection device an ejector beam provided with an ejection surface, swingable about the input support cylinder, which reaches up to the support cylinder and whose upper limit in its forward swung position extends into the region of the apex line of the output support cylinder. In this way fully-wound rolls with a small diameter can be clamped between the ejection surface of the ejector beam and the support cylinder over which they are supposed to be ejected and can be lifted from the winding bed by a rotation of this support cylinder.

DE-OS 40 03 504 describes a generic winding machine with support cylinders whose ejection device is an ejector roll, which is supported on lateral swingable swivel arms freely rotatable about the axis of the input support cylinder which deflects the web from underneath into the winding bed. Upstream of the input support cylinder a device for applying adhesive and a perforating device for weakening the web are arranged. At the moment of roll change, the web is first weakened and the weakened portion is moved into the winding bed. The severing of the web takes place subsequently by increasing the traction due to the rotation of the winding roll with the output support cylinder, while the ejector roll slightly lifts the winding roll from the input support cylinder. The fully-wound rolls are subsequently ejected by the ejector roll over the output support cylinder.

In order for the ejector roll to be capable of ejecting winding rolls with a larger diameter (e.g. 1000 mm) over the output support cylinder, it is necessary to arrange it at a certain radial distance from the input support cylinder. However then it is not in a position to lift winding rolls with a smaller diameter (e.g. 200 mm) from the input support cylinder for the cutting of the web.

OBJECT OF THE INVENTION

It is the object of the invention to improve the roll ejection device in a winding machine with support cylinders so that it is capable to lift winding rolls with a great variety of diameters from the input support cylinder for cutting, as well as to eject them from the winding bed over the output support cylinder.

SUMMARY OF THE INVENTION

This object is attained, in accordance with the invention in a winding machine with support cylinders for winding webs of material, particularly paper or cardboard webs, wherein two driven support cylinders form a winding bed between them and the material web is deflected by an input support cylinder from beneath into the winding bed. A device is provided for lifting a fully-wound roll from the input cylinder and for ejection of the fully wound roll from the winding bed. This device can comprise a rotatably supported roller which can swing about the input support cylinder in a direction of the winding bed. An ejector beam is swingable about the input support cylinder and has an ejection surface extending approximately radially of the input support cylinder and ending at a distance therefrom. The lifting roller is swung together with the ejector beam and is journaled to rotate in the same direction as the input support cylinder in a free space between the ejection surface and the input support cylinder. The lifting roller projects peripherally with respect to the ejection surface.

According to the invention, for the ejection of the fully-wound winding rolls from the winding bed an ejector beam with an ejection surface is used, which for the ejection of winding rolls with a large diameter is arranged at a sufficient distance from the input support cylinder. For lifting winding rolls with a smaller diameter prior to the cutting of the web, in the free space between the ejection surface and the support cylinder a lifting roll is arranged at the shortest possible distance from the support cylinder which is thus capable of lifting winding rolls with small diameter. During the lifting of the winding rolls first of all contact with the ejection surface is avoided, so that the winding rolls can be rotated without problems by the output support cylinder for the cutting of the web and/or for making adherent seams.

The ejection surface can be swingably supported at a side of the ejector beam opposite the lifting roller and a core channel can be arranged in the ejector beam underneath the ejector surface. Alternately, a separate core insertion device can be provided with a core channel swingable about the output support cylinder in a direction toward the winding bed. A free-wheel lock can prevent the lifting roller from rotating in a direction opposite to direction of rotation of the input support roller.

A perforating device can be provided upstream of the input support cylinder for weakening the web and a device can be provided for applying an adhesive means to the web.

With the core insertion device integrated in the ejector beam the new cores can be inserted at the same time as the ejection of the fully-wound rolls. A separate core-insertion device makes possible the use of cores with a very large diameter.

The free-wheel lock acting in a single direction makes possible the removal from the winding bed of winding rolls whose diameter is too small for ejection. These winding rolls can be clamped between the output support cylinder and the lifting roll and can be lifted by a rotation of this support cylinder until they are clamped between the ejection surface and the support cylinder and are this way further lifted.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
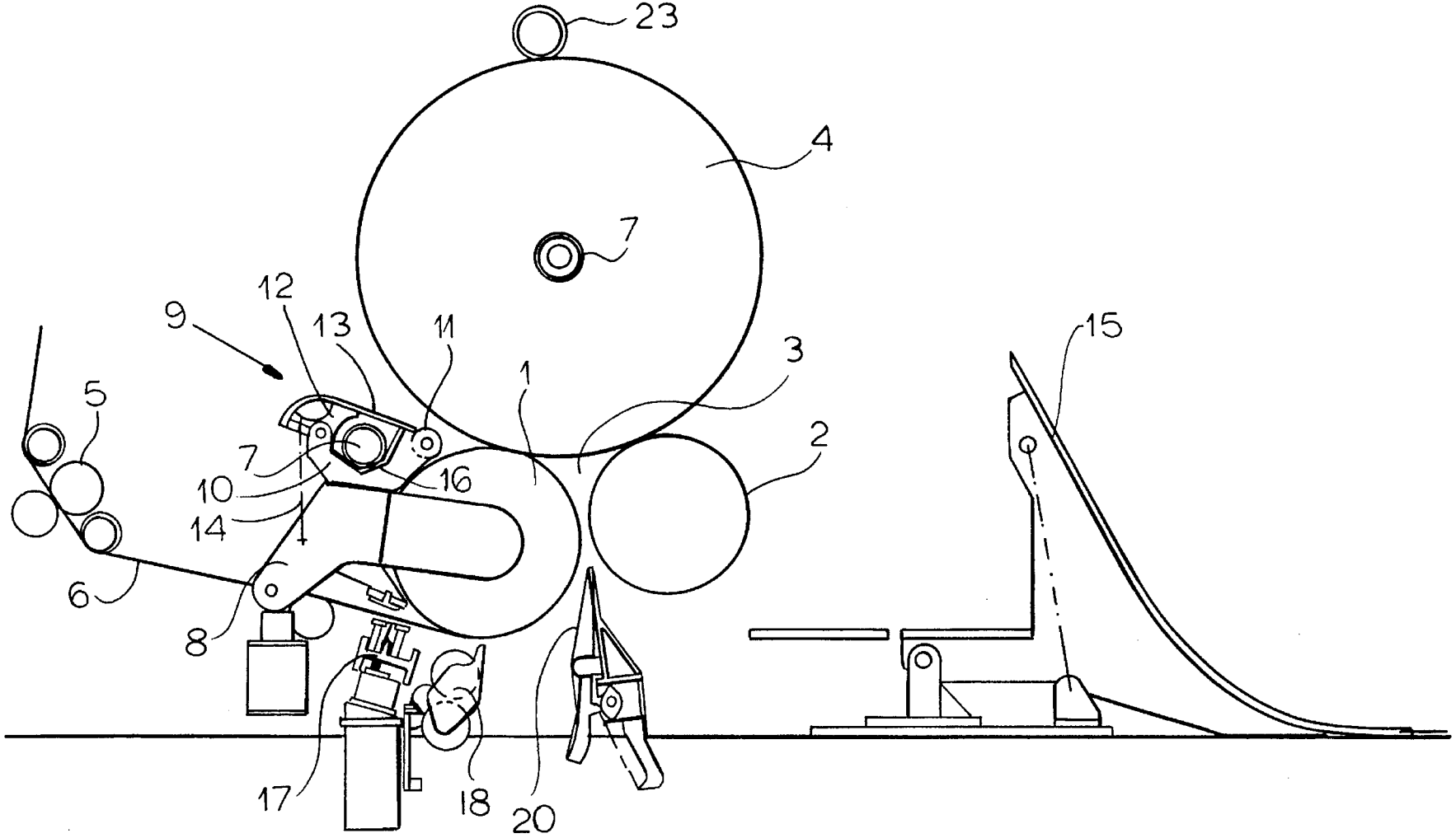
FIG. 1 is a schematic side view of a winding machine with support cylinders according to the invention during winding.

The winding machine with support cylinders has two driven support cylinders 1, 2, forming a winding bed 3 between them, so that the winding rolls rest during winding on the support cylinders 1, 2. The material web 6, preferably a paper or cardboard web, divided into individual webs by a longitudinal cutting device 5, is deflected from underneath by the input support cylinder 1, and is guided through the gap between the support cylinders 1, 2 into the winding bed 3 and is wound on aligned cores 7. Such winding machines with double support rollers are widely known and described for instance in DE-OS 32 07 461, so that the individual parts which do not relate to the invention have not been described.

At each of the two frontal sides (ends) of the input support cylinder 1 downwardly bent swivel levers 8 are supported in the machine stand swingably about an axis coaxial with the axis of rotation of the support cylinder 1, by means of a piston-cylinder unit. The levers 8 carry on their upper side a roll-lifting and roll-ejection device with an integrated core insertion mechanism, which subsequently will be described more fully.

On the upper side of the radially extending part of each swivel lever 8 and outside of the cross-section area of the support cylinder 1 an ejection beam 9 extending over the work width is fastened. The ejection beam 9 consists of support 10 with an approximately fork-like cross section, which is open in the direction of the inward swinging motion towards the winding bed 3. At the free end of the arm of the support part 10 adjacent to the support cylinder 1 a lifting roller 11 extending over the work width of the machine, i.e. the axial length of the support cylinders 1, 2, is supported at the smallest possible distance from the support cylinder 1. The lifting roller 11 is freely rotatable in the same direction of rotation—in the embodiment illustrated, counterclockwise direction as the support cylinder 1. A rotation in the opposite direction, i.e. the clockwise direction is prevented by a free-wheel lock not shown in the drawing. At the free end of the other arm of the support part 10 a lever 12 is linked, to which the ejection surface 13 is fastened. The ejection surface 13 can be pivoted by means of a piston-cylinder unit 14 mounted on the bent part of the swivel arm 8 about an axis parallel to the axis of the support cylinder 1 and rests in its folded position on the arm of the support part 10 which is adjacent to the support cylinder 1. The piston-cylinder unit 14 is only indicated in FIGS. 1 to 6 and described in detail in FIGS. 7 to 9. The ejection surface 13 projects so far outwardly in radial direction from the area of the lifting roller 11 towards the support cylinder 1 that heavy winding rolls can be ejected without problems from the winding bed over the support cylinder 2 onto a swingable lowering platform 15 arranged next to the support cylinder 2.

The support part 10 bears between its arms a core channel 16 extending over the working width, whereby the exit opening of the core channel 16 between the lifting roller 11 and the lever 12 can be opened and closed by horizontal swinging of the ejection surface 13. In order to make possible for the lifting roller 11 to slightly lift a winding roll 4 from the support cylinder 1 without having the winding roll 4 rest immediately against the ejection surface 13, it slightly projects peripherally with respect to the ejection surface 13, when the latter folds down in ejecting position while the exit opening of the core channel 16 is closed. In this way the ejection surface 13 in down-swing position lies at an acute angle with respect to the tangent to the outer side of lifting roller 11 running through the axis of support cylinder 1.

On the incoming side, shortly before the web 6 touches the support cylinder 1, a perforation device 17 and subsequently, in the area where the support cylinder 1 is wrapped by the web 6, a series of adhesive dispensers 18 distributed over the work width, are arranged. With the perforation device 17 the web 6 can be weakened along a line running across it. The adhesive dispensers 18 apply a series of double-sided adhesive tapes to the web 6, by means of which the new initial web portions created after the cutting of the web 6 are glued to the new cores 7 and the web ends are glued to the fully-wound rolls 4. Underneath the gap between the support cylinders 1, 2 a support 19 extending over the width of the machine is provided, on which over the work width a series of free-running bands 20 are fastened, which when the support 19 is raised can be pushed against the input support cylinder 1 for holding the newly created initial web portions in place after cutting.

In the winding machine with support cylinders shown in FIG. 1 during winding, a winding roll replacement as shown in FIGS. 2 to 6 is performed.

Figure 2:
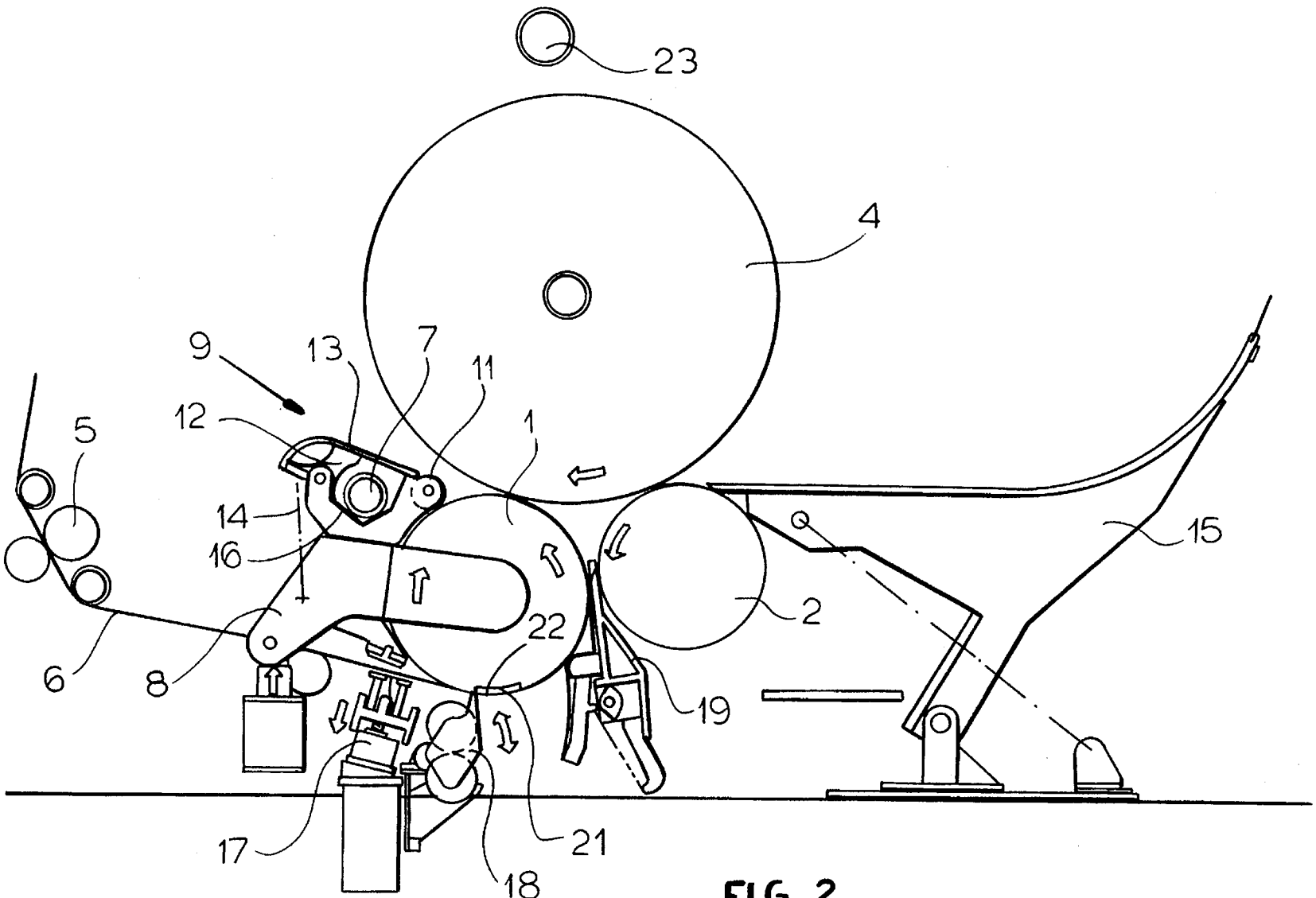
FIG. 2 is a similar view which shows the start of a roll replacement after the adhesive strip has been applied and the web has been perforated.

Already while one set of winding rolls 4 is wound, a new set of winding cores 7 is inserted in the core channel 16 and the latter is closed by swinging down the ejection surface 13. Subsequently the machine is stopped, and the web 6 is weakened by the perforating device 17 along a weakening line 21. After the machine is restarted the adhesive-tape dispensers 18 apply adhesive strips 22 on both sides of the weakening line 21, and the support 19 is raised with its point through the support cylinder gap, so that the bands 20 hold the web 6 against the support cylinder 1. The lowering platform 15 is swung upwardly towards the support cylinder 2 for receiving the fully-wound winding rolls 4 (FIG. 2).

Figure 3:
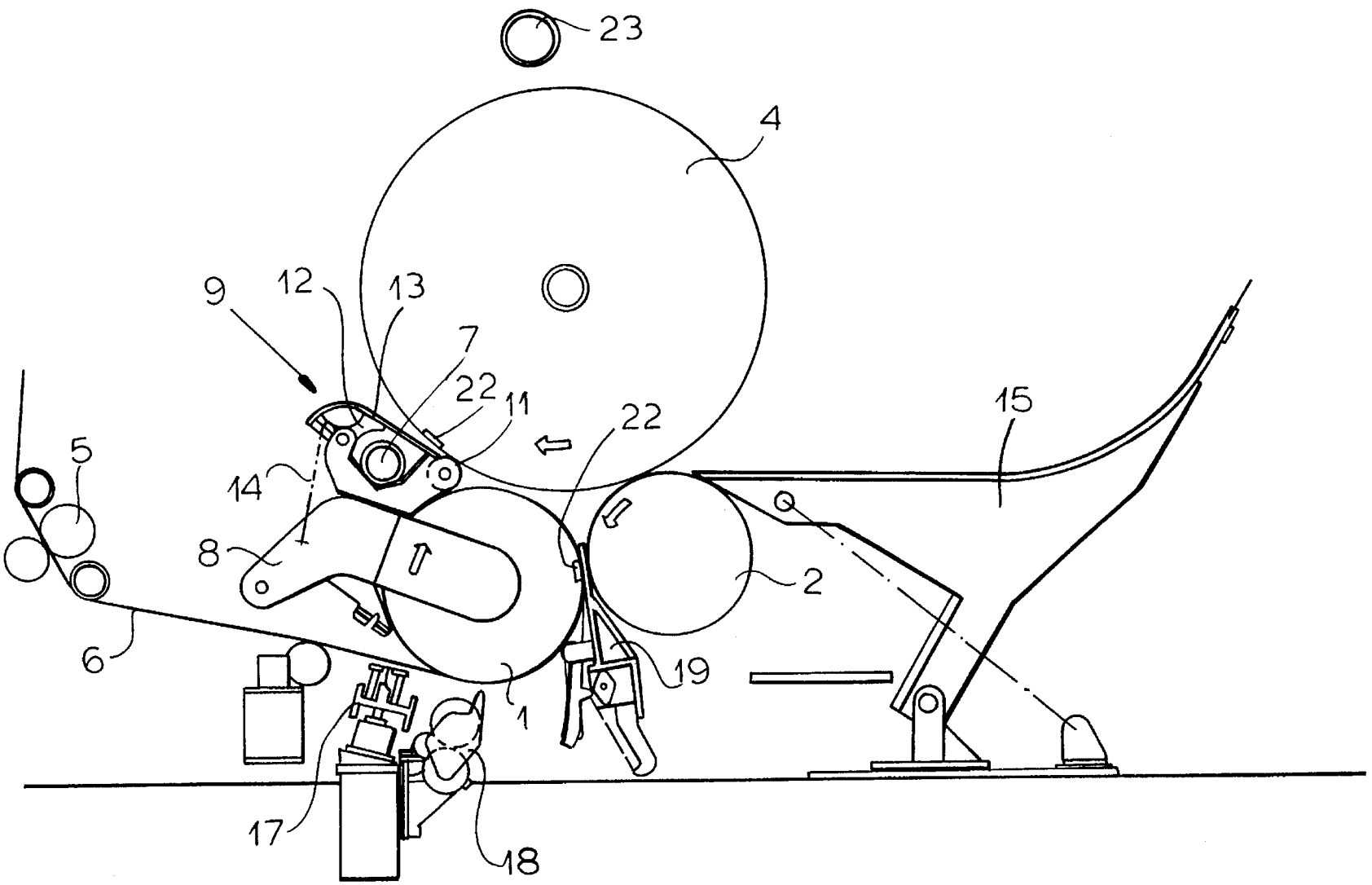
FIG. 3 is another view similar to FIG. 1 which shows the lifting of the winding roll for the cutting of the web.

When the weakening line 21 is located in the gap between the support cylinders 1, 2, the machine is stopped again and the fully-wound winding rolls 4 are slightly lifted by the lifting roller 11 from the support cylinder 1, whereby they do not rest against the ejection surface 13 of the ejector beam 9. Subsequently the support cylinder 2 is rotated counterclockwise, thereby the web 6 is torn along the weakening line 21, if this has not already occurred when the winding rolls 4 were lifted. As shown in FIG. 3 the winding rolls 4 are rotated until the web ends with a part of the adhesive stripes 22 have been moved through the gap between the winding rolls 4 and the lifting roller 11. Thereby the web ends are glued to the fully-wound winding rolls 4. The swivel arms 8 are subsequently swung further upwards, so that the ejection surface 13 presses the winding rolls 4 away over the support cylinder 2 onto the lowering platform 15.

Figure 4:
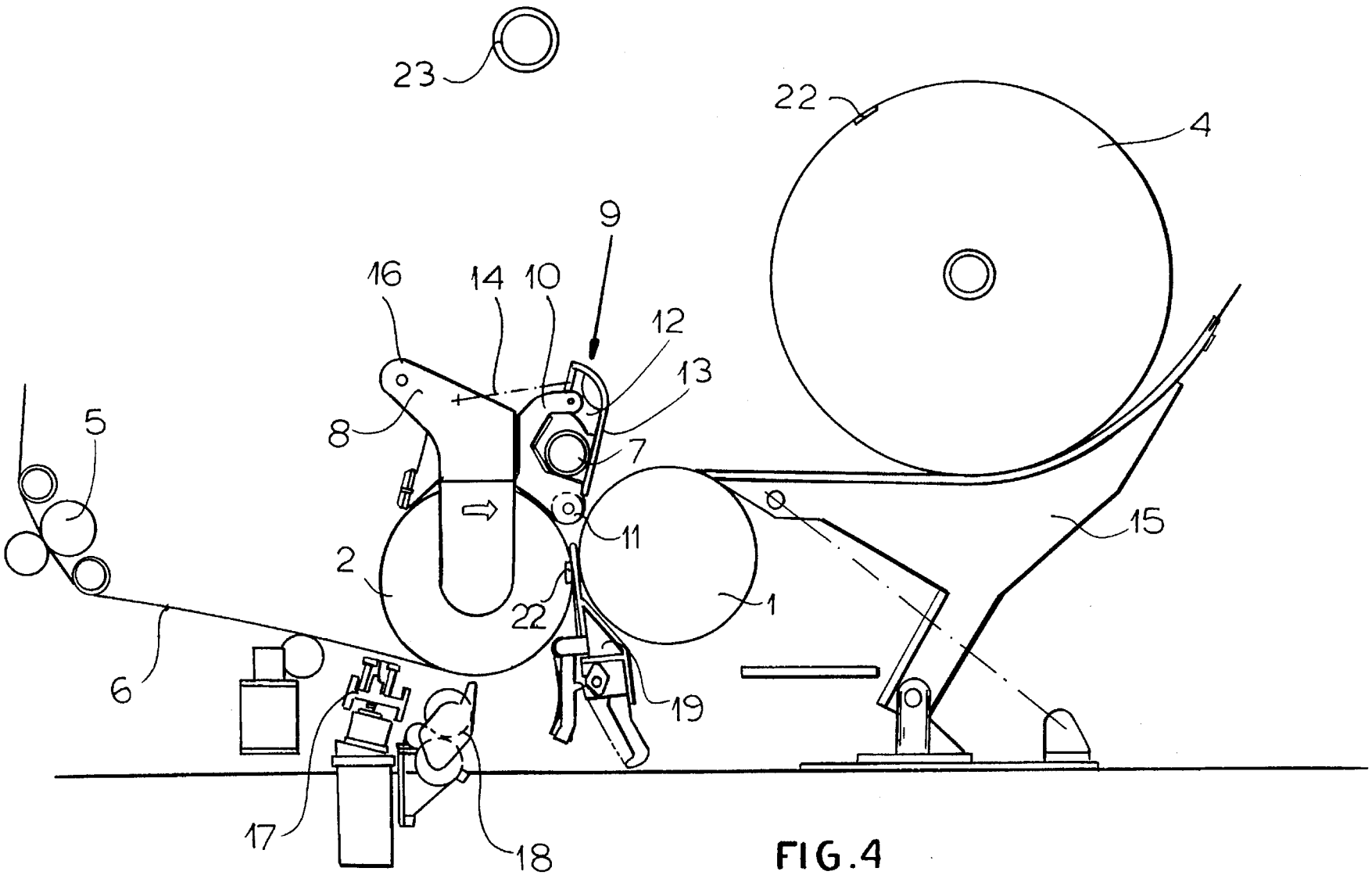
FIG. 4 is yet another schematic side view which shows the ejection of a winding roll.
Figure 5:
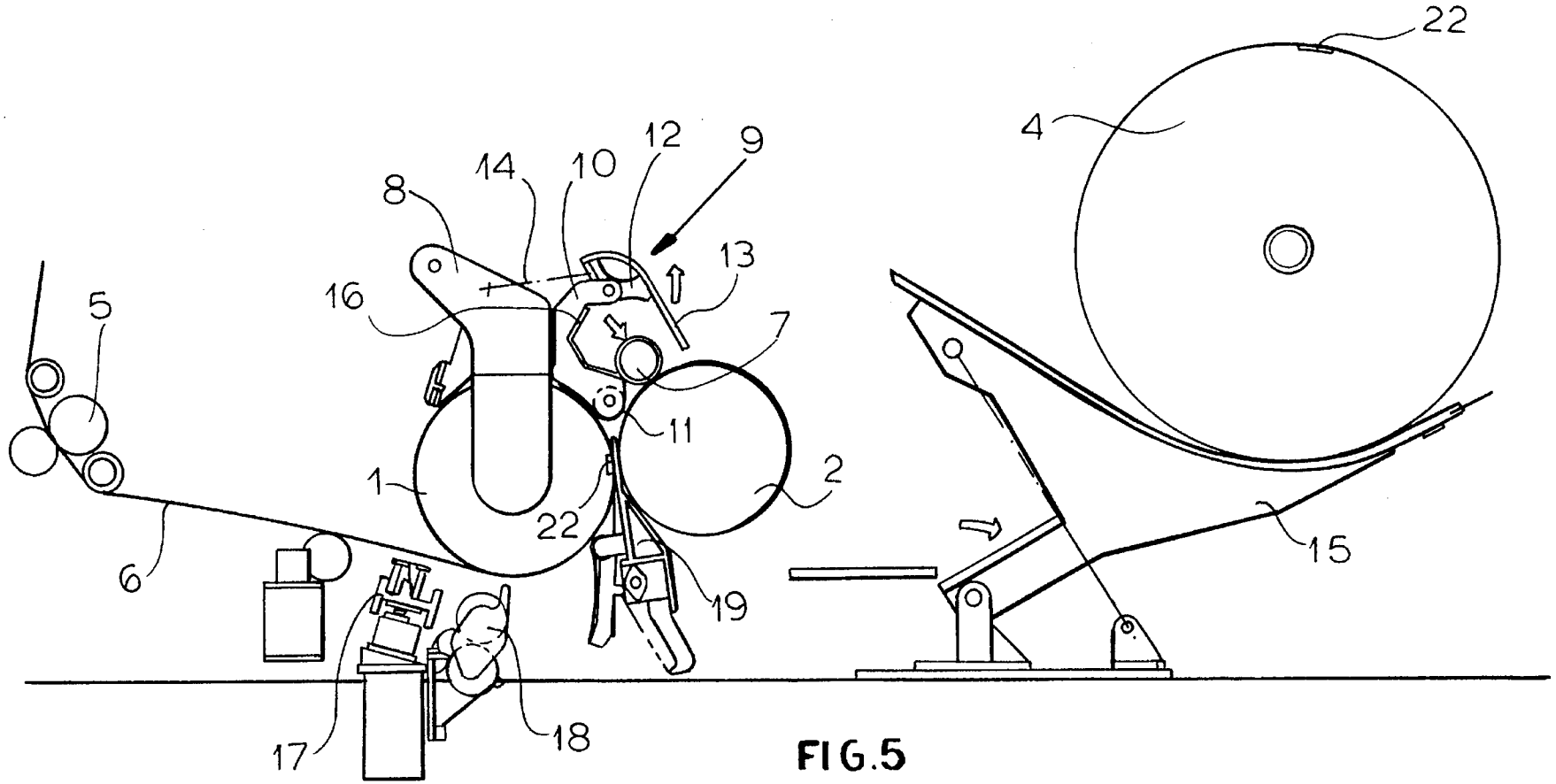
FIG. 5 is a similar view which shows the insertion of a new winding core.

Thereby the core channel 16 with a set of new cores 7 moves into the winding bed 3 (FIG. 4). In this position the ejection surface 13 is swung up, so that the cores 7 roll into the winding bed 3, guided by the inside of the ejection surface 13 (FIG. 5). During the subsequent return swing of the swivel arms 8 the cores 7 roll into their winding position in the winding bed 3.

Figure 6:
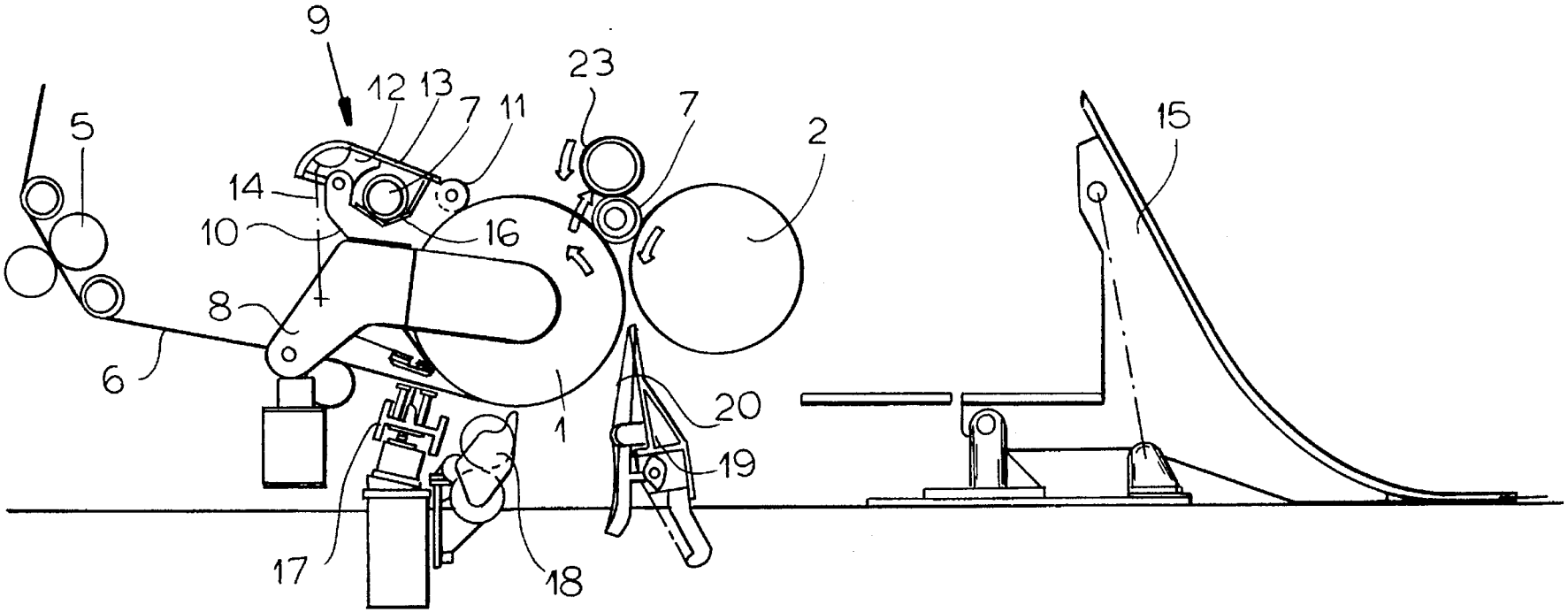
FIG. 6 is a side view which shows the fastening of the initial web portion to the new winding core.

After the pressure roller 23 is applied, the winding machine is started. Thereby the initial web portions provided with an adhesive strip 22 are glued to the cores 7 (FIG. 6). After the start of the winding the support 19 with the bands 20 is lowered and the winding machine can be accelerated to full winding speed.

Figure 7:
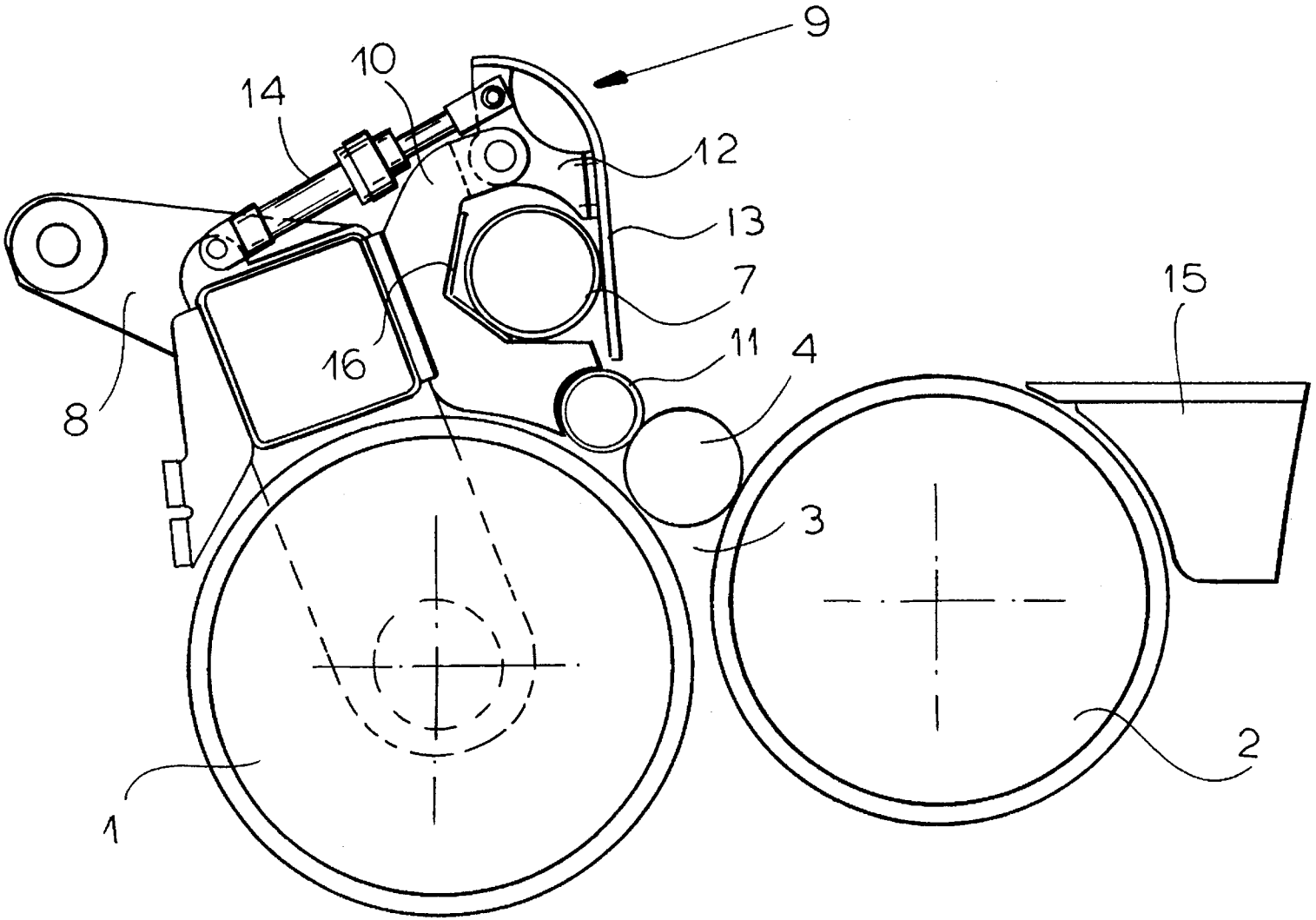
FIG. 7 to 9 are side views to a larger scale which show the removal of winding rolls with a very small diameter from the winding bed.
Figure 8:
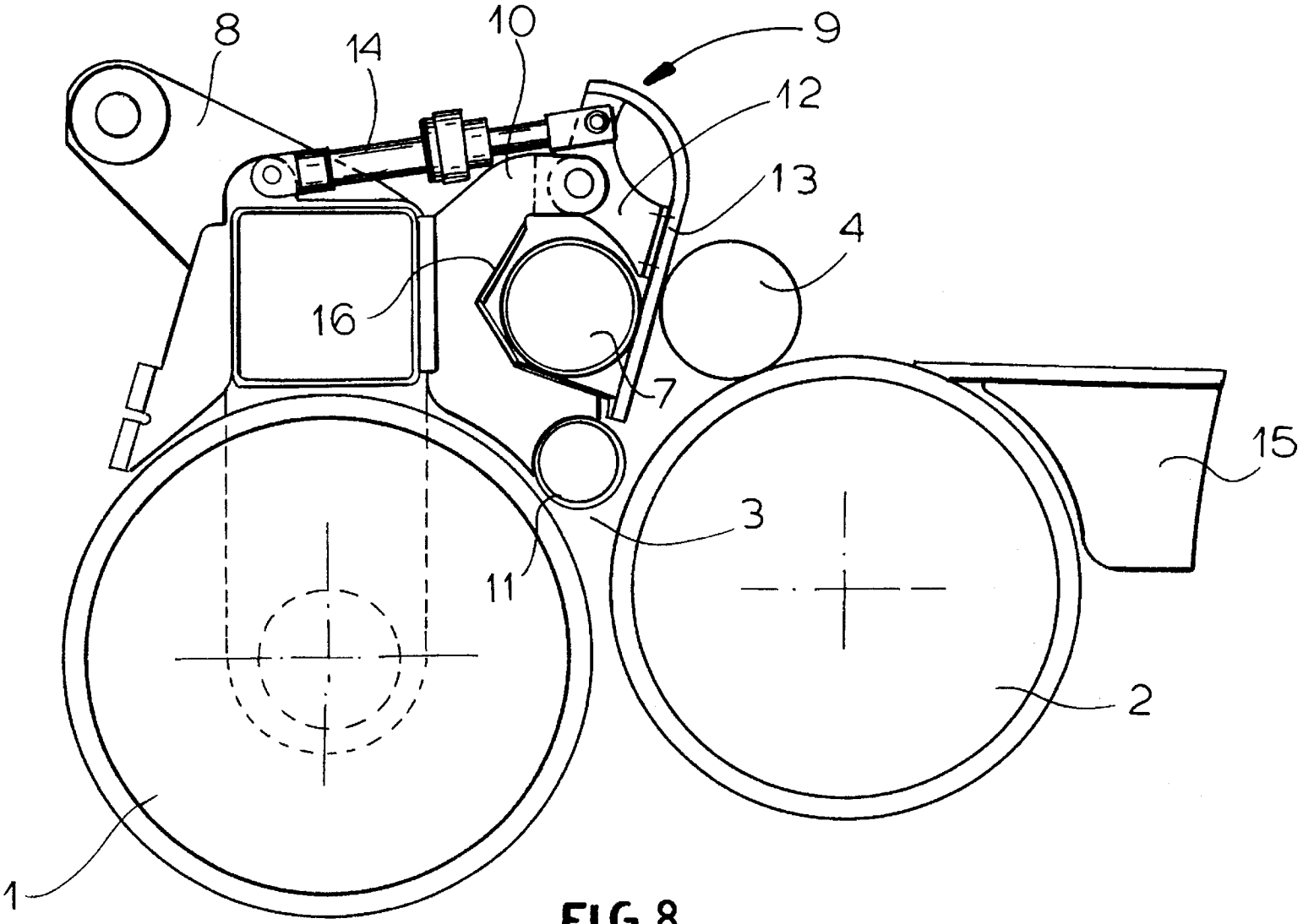
Figure 9:
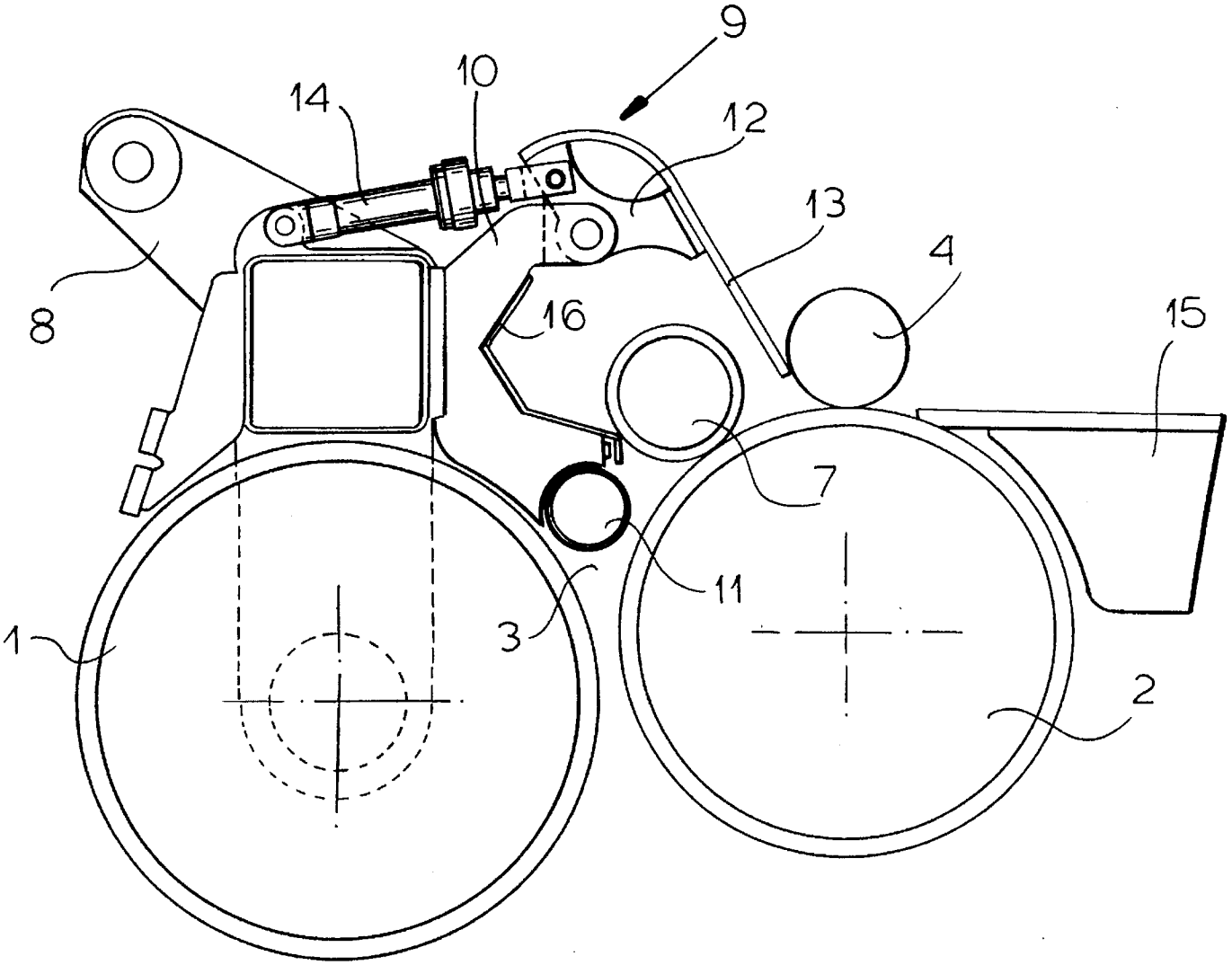

If winding rolls 4 having a diameter smaller than the minimal diameter required for ejection have to be removed from the winding bed 3, e.g. when shortly after the start of the winding operation a complete set of rolls have to be declared rejects, this is done in the manner illustrated in FIGS. 7 to 9.

With a new set of cores 7 lying in the core channel 16 the swivel arms 8 are swung over the support cylinder 1 until the lifting roller 11 rests against the winding rolls 4 to be ejected and presses them with a defined force against the support cylinder 2 (FIG. 7). Subsequently the support cylinder 2 is driven in clockwise direction. Due to the rotary motion of the support cylinder 2 the rolls are lifted, since the free-wheel lock of the lifting roller 11 does not allow rotary movements in clockwise direction. The piston-cylinder unit presses the swivel arms 8 in the direction of the support cylinder 2, so that the ejection surface 13 comes to lie against the rolls 4 immediately after they have been lifted enough, so that they can no longer be held by the lifting roller 11. Through further rotation of the support cylinder 2 the winding rolls 4 are pushed upwards between the support cylinder 2 and the ejection surface 13 until they reach the area of the apex line of the support cylinder 2 (FIG. 8), where due to the upward swing of the ejection surface 13 over the apex of the support cylinder 2 they are pushed away onto the lowering platform 15. When the ejection surface 13 is swung up, the new winding cores 7 are simultaneously deposited in the winding bed (FIG. 9). The initial web portions are then fastened to the new cores 7 in the manner described in FIG. 6.

Figure 10:
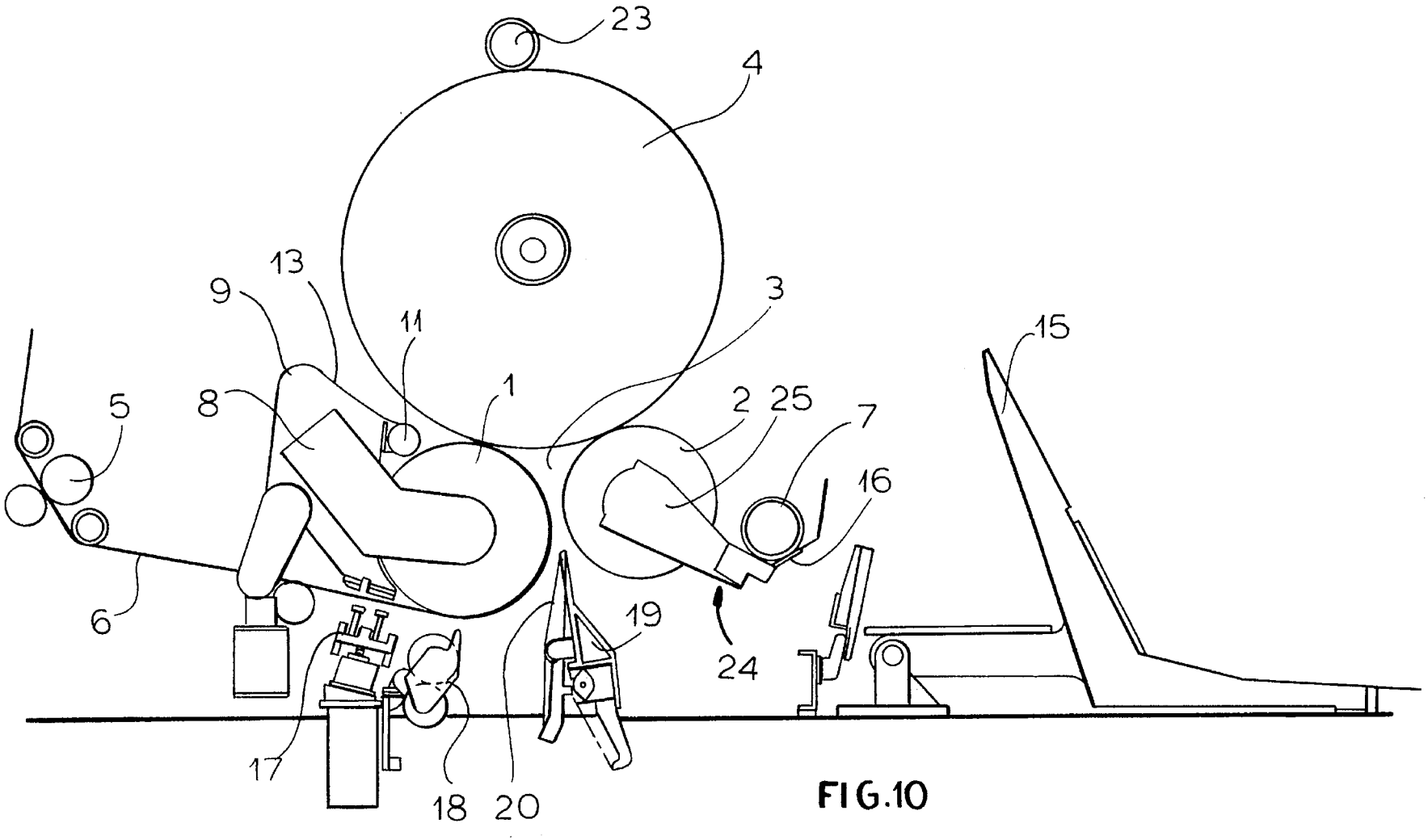
FIG. 10 is a view similar to FIG. 1 which shows a winding machine with support cylinders with a separate core-insertion device, swingable about the output support cylinder.

FIG. 10 shows a winding machine with support cylinders with a separate core insertion device 24 swingable about the output support cylinder 2. In order to avoid repetition, the components which are identical to the ones of the embodiment examples according to FIGS. 1 to 9 have corresponding reference numerals. A separate core insertion device 24 can be required when cores 7 with such a large diameter (for instance larger than 230 mm) are used, that there is not enough space in the ejector beam 9 to accommodate the insertion device. The core channel 16 is mounted to the ends of two swivel arms 25 which can be swung upwards in counterclockwise direction from a lowered core-receiving position into an approximately vertical position, wherein the cores 7 roll from the core channel 16 into the winding bed 3. The ejector beam 9 carries lifting roller 11 in an extension of the ejection surface 13. Also in this embodiment the lifting roller 11 slightly projects peripherally with respect to the ejection surface 13, and therefore the ejection surface 13 runs at an acute angle with respect to the tangent to the outer side of lifting roller 11 which passes through the axis of support cylinder 1. In this way, when the winding roll is lifted by the lifting cylinder 11, it has no contact with the ejection surface 13. The upper limit that the ejection surface 13 reaches in its forward swung position is up into the area of the apex line of the output support cylinder 2, so that winding rolls with a very small diameter can be clamped between the ejection surface 13 and the support cylinder 2 and can be removed from the winding bed 3 by a rotation of the support cylinder 2.

The winding roll replacement takes place in a manner similar to the method according to FIGS. 2 to 6, with the difference that after the winding rolls have been ejected and have been lowered on the lowering platform 15, first the ejector beam 9 is swung back in its waiting position and subsequently the new cores 7 are introduced in the winding bed 3 by horizontally swinging the swivel arms 25 towards it. The new initial web portions can be glued to the new cores 7 already during the return swing of the core channel 16. In the embodiment of FIG. 10 a roll replacement requires more time, because the new cores 7 are not introduced into the winding bed 3 at the same time with the ejection of the fully-wound rolls 4, this operation taking place in a separate step.

We claim:

1. A winding machine for winding a web of material comprising:

two driven support cylinders forming a winding bed between them, a material web being deflected by one of the support cylinders and guided from underneath into the winding bed; and a device for lifting a fully-wound winding roll from said one of said support cylinders for ejection of the fully-wound roll from the winding bed, said device comprising:

a rotatably supported lifting roller, an ejector beam swingable about said one of said support cylinders in the direction of the winding bed and having an ejection surface extending approximately radially with respect to said one of said support cylinders and which ends at a distance from said one of said support cylinders, means for supporting said lifting roller for swinging said lifting roller together with the ejector beam, said lifting roller being journaled to rotate in the same direction as said one cylinder in a free space between the ejection surface and said one of said support cylinders, said lifting roller projecting peripherally with respect to the ejection surface; and a free-wheel lock preventing the lifting roller from rotating in a direction opposite to a direction of rotation of said one of said support cylinders.

2. The winding machine defined in claim 1 wherein the ejection surface is swingably supported at a side of the ejector beam opposite said lifting roller and a core channel is formed in the ejector beam underneath the ejection surface.

3. The winding machine defined in claim 1 further comprising a core insertion device with a core channel swingable about the other of said support cylinder in a direction towards the winding bed.

4. The winding machine defined in claim 1 further comprising a perforating device upstream of said one of said support cylinders for weakening the web and a device for applying an adhesive to the web.

* * * * *